US009618206B2

(12) United States Patent
Genin et al.

(10) Patent No.: US 9,618,206 B2
(45) Date of Patent: Apr. 11, 2017

(54) ANNULAR HELMHOLTZ DAMPER

(71) Applicant: ALSTOM Technology Ltd, Baden (CH)

(72) Inventors: Franklin Marie Genin, Baden (CH); Naresh Aluri, Ennetturgi (CH); Mirko Ruben Bothien, Zürich (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 262 days.

(21) Appl. No.: 14/488,652

(22) Filed: Sep. 17, 2014

(65) Prior Publication Data

US 2015/0000282 A1 Jan. 1, 2015

Related U.S. Application Data

(63) Continuation of application No. PCT/EP2013/055734, filed on Mar. 19, 2013.

(30) Foreign Application Priority Data

Mar. 20, 2012 (EP) ..... 12160385

(51) Int. Cl.
*F23R 3/00* (2006.01)
*F23M 20/00* (2014.01)

(52) U.S. Cl.
CPC ..... *F23R 3/002* (2013.01); *F23M 20/005* (2015.01); *F23R 2900/00014* (2013.01); *Y10T 29/49* (2015.01)

(58) Field of Classification Search
CPC ..... F23R 3/002; F23R 2900/00014; F23M 20/005
USPC ..... 60/725, 752
See application file for complete search history.

(56) References Cited

U.S. PATENT DOCUMENTS

| | | | | |
|---|---|---|---|---|
| 4,122,674 | A | 10/1978 | Andersson et al. | |
| 5,644,918 | A * | 7/1997 | Gulati | F23R 3/002 431/114 |
| 6,351,947 | B1 | 3/2002 | Keller et al. | |
| 6,973,790 | B2 * | 12/2005 | Suenaga | F23M 20/005 181/213 |
| 6,981,358 | B2 * | 1/2006 | Bellucci | F23D 11/402 60/39.17 |
| 2005/0199439 | A1 | 9/2005 | Goenka et al. | |
| 2006/0059913 | A1 * | 3/2006 | Bethke | F23M 20/005 60/725 |
| 2008/0295519 | A1 | 12/2008 | Park | |
| 2013/0019602 | A1 * | 1/2013 | Kim | F23R 3/10 60/725 |

FOREIGN PATENT DOCUMENTS

| | | | |
|---|---|---|---|
| DE | 196 35 545 | C1 | 2/1998 |
| EP | 0 111 336 | A2 | 6/1984 |
| EP | 0 577 862 | A1 | 1/1994 |
| EP | 1 213 539 | A1 | 6/2002 |
| EP | 2 397 760 | A1 | 12/2011 |

* cited by examiner

*Primary Examiner* — Steven Sutherland
(74) *Attorney, Agent, or Firm* — Buchanan Ingersoll & Rooney PC

(57) ABSTRACT

The damper arrangement include two concentric hollow shapes, each having a wall, wherein the walls form an annular volume therebetween. The damper arrangement further includes one or more necks for connecting to a combustion chamber at corresponding one or more contact points. The one or more necks are connected to the annular volume.

17 Claims, 15 Drawing Sheets

ANNULAR HELMHOLTZ DAMPER

CROSS-REFERENCE TO RELATED APPLICATIONS

This application claims priority to PCT/EP2013/055734 filed Mar. 19, 2013, which claims priority to European application 12160385.6 filed Mar. 20, 2012, both of which are hereby incorporated in their entireties.

TECHNICAL FIELD

The present invention relates to a damper arrangement. In particular, the damper arrangement is used to damp pressure oscillations that are generated during operation of a gas turbine provided with a lean premixed, low emission combustion system.

BACKGROUND

Gas turbines are known to comprise one or more combustion chambers, wherein a fuel is injected, mixed to an air flow and combusted, to generate high pressure flue gases that are expanded in a turbine.

During operation, pressure oscillations may be generated that could cause mechanical damages to the combustion chamber and limit the operating regime. Nevertheless, frequency of these pressure oscillations may slightly change from gas turbine to gas turbine and, in addition, also for the same gas turbine it may slightly change during gas turbine operation (for example part load, base load, transition etc.).

Mostly gas turbines have to operate in lean mode for compliance to pollution emissions. The burner flame during this mode of operation is extremely sensitive to flow perturbations and can easily couple with dynamics of the combustion chamber to lead to thermo-acoustic instabilities. For this reason, usually combustion chambers are provided with damping devices, such as quarter wave tubes, Helmholtz dampers or acoustic screens, to damp these pressure oscillations.

With reference to FIG. 1, traditional Helmholtz dampers 1 include a damping volume 2 (i.e. a resonator volume) and a neck 3 (an entrance portion) that are connected to a front panel wall 4 (shown by line pattern) of a combustion chamber 5 where a burner 6 is connected. The pressure oscillations generated due to the combustion need to be damped.

The resonance frequency (i.e. the damped frequency) of the Helmholtz damper depends on the geometrical features of the resonator volume 2 and neck 3 and must correspond to the frequency of the pressure oscillations generated in the combustion chamber 5.

Particularly, the volume and neck geometry determine the Eigen frequency of the Helmholtz damper. The maximum damping characteristics of the Helmholtz damper is achieved at the Eigen frequency and it is typically in a very narrow frequency band.

Normally, since the Helmholtz dampers are used to address low frequency range pressure pulsations (50-500 Hz), the volume size of the Helmholtz damper increases. In some cases the volume of Helmholtz damper may even be comparable to burner size. This leaves very little space around the front panel wall 4 for installation of these dampers. Moreover, in order to damp pressure oscillations in a sufficiently large bandwidth, multiple Helmholtz dampers need to be connected to the combustion chamber.

As there is limited space on the front panel wall 4, there are limited options for installation of traditional Helmholtz damper 1. This is shown in FIG. 2, where on front panel wall 4, one burner 6 has to be removed in order to position a Helmholtz damper 1. This eventually is trade off between the number of burners 6 that combustion chamber 5 can accommodate versus the number of traditional Helmholtz damper 1.

Hence, above-mentioned solutions suffer from the space constraint around burner front panel wall for damper installation. Moreover, these solutions do not allow dampers to have a broadband damping frequency in the combustion chamber.

SUMMARY

The technical aim of the present invention therefore includes providing a damper arrangement addressing the aforementioned problems of the known art.

Within the scope of this technical aim, an aspect of the invention is to provide a damper arrangement and a method for designing same that permits positioning of the damper around the burner of the combustion chamber.

A further aspect of the invention is to provide a damper arrangement that is able to cope with the frequency shifting of the pressure oscillations with no or limited need of fine tuning.

Another aspect of the invention is to provide a damper arrangement that is able to simultaneously damp multiple pulsation frequencies in broadband range by being connected to a combustion chamber at more than one location.

Another aspect of the invention is to provide a damper arrangement that is very simple, in particular when compared to the traditional damper arrangements described above.

Yet another aspect of the invention is to provide a damper arrangement that comprises two concentric hollow shapes each having a wall, wherein the two walls forms an annular volume therebetween, and one or more necks for connecting to a combustion chamber at corresponding one or more contact points. The one or more necks are connected to the annular volume.

In another aspect of the invention, the one or more contact points correspond to one or more pulsation frequencies.

In yet another aspect of the invention, the combination of the annular volume and the one or more necks are tuned to damp one or more pulsation frequencies.

The technical aim, together with these and further aspects, are attained according to the invention by providing a damper arrangement and a method for designing same in accordance with the accompanying claims.

BRIEF DESCRIPTION OF THE DRAWINGS

Further characteristics and advantages of the invention will be more apparent from the description of a preferred but non-exclusive embodiment of the damper arrangement illustrated by way of non-limiting example in the accompanying drawings, in which.

DETAILED DESCRIPTION

Figure 1:
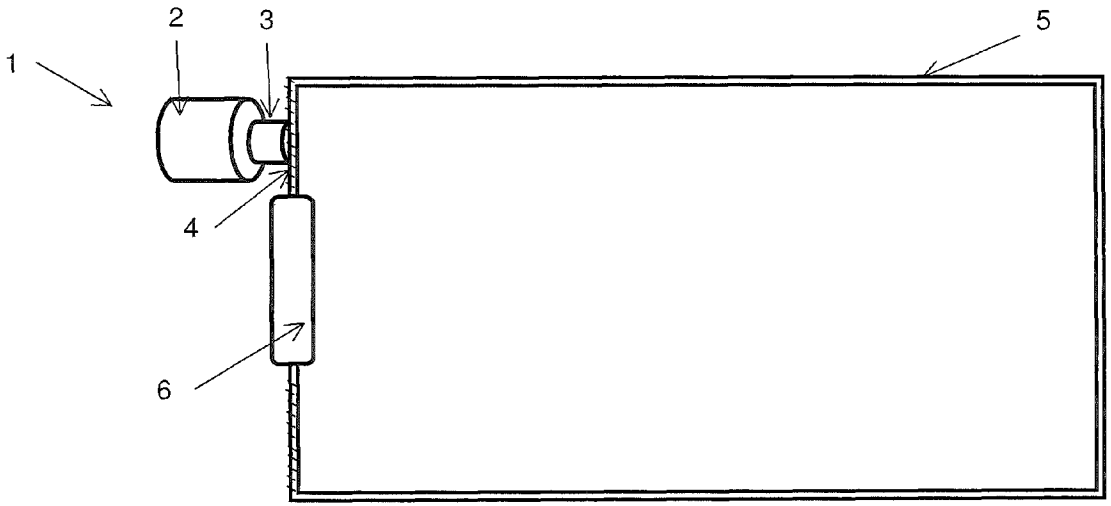
FIG. 1 is a schematic view of a traditional Helmholtz damper connected to a combustion chamber according to the prior art.

Preferred embodiments of the present disclosure are now described with reference to the drawings, wherein like reference numerals are used to refer to like elements throughout. In the following description, for purposes of explanation, numerous specific details are set forth in order to provide a thorough understanding of the disclosure. It may be evident, however, that the disclosure may be practiced without these specific details.

Figure 3:
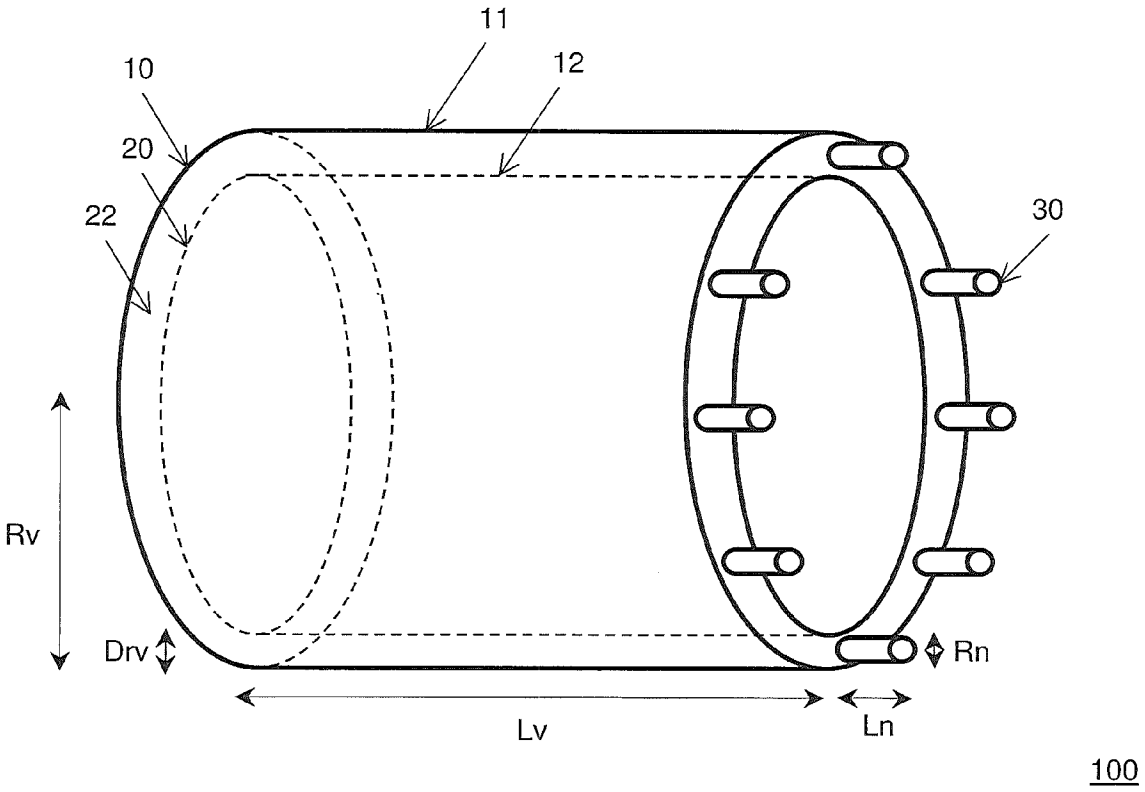
FIG. 3 shows a schematic view of an annular Helmholtz damper in accordance with an embodiment of the invention.

With reference to FIG. 3, a damper arrangement 100, i.e., a damper 100 is provided that is able to deal with the problem of space constraint around burner front panel 4 (i.e. front panel wall 4) and also damp multiple pulsation frequencies occurring in combustion chamber 5. The damper 100 is hereinafter interchangeably referred to as an annular Helmholtz damper 100. Combustion chamber 5 in exemplary embodiment is the combustion chamber of a gas turbine.

In accordance with an embodiment of the invention, damper 100 comprises two concentric hollow shapes 10 and 20 each having a wall 11 and 12 respectively. Both walls 11 and 12 form an annular volume 22 therebetween. In other words, inner face of wall 11 and outer face of wall 12 form the annular volume 22. The damper 100 further comprises one or more necks 30 that connect damper 100 to combustion chamber 5. The one or more necks 30 connect at one end to the annular volume 22 and at the other end to corresponding one or more contact points on combustion chamber 5.

In a preferred embodiment of the invention, the two concentric hollow shapes 10 and 20 are hollow cylindrical volumes, each having a wall 11 and 12, respectively. Both these walls 11 and 12 thus form the annular volume 22 therebetween. Hereinafter, the term hollow shape will be interchangeably referred to hollow volume. It will be apparent to a person skilled in the art that cylindrical shape is only taken for exemplary purposes throughout the description, however it does not limit the scope of the invention to this shape and can be extended to all other shapes that are concentric and have a provision to create some annular volume in between the walls of the two shapes.

It is well known that the damper 100 will have best damping effect when it is close to the pulsation maximum of the standing wave pattern in combustion chamber 5. The resonance frequency of a traditional Helmholtz damper (prior art damper) is given by:

$$Fn=(C/2\pi)*\sqrt{An/V*Ln}$$

where Fn is the resonance frequency of damper, An is the area of neck, V is the volume of resonator in the damper, Ln is the length of neck. C is the mean speed of sound of fluid inside the damper. Typically, at base load conditions, C is around 500-550 m/s.

The resonance frequency Fn can be tuned to damp one or more pulsation frequencies that occur in combustion chamber 5. Multiple frequencies can be addressed when either multiple dampers are used, or a damper with multiple volumes and necks is used. Typically, Fn ranges between 50 to 500 Hz. Assuming during normal operations, if a traditional damper has to be fine tuned to resonance frequency Fn as 150 Hz, for a constant C as 500 m/s, the area of neck An and volume of resonator V can be calculated as:

Rn=0.015 m (radius of neck)

Ln=0.1 m (length of neck)

Lv=0.25 m (length of volume)

Rv=0.05 m (radius of volume)

Now, in order to have annular Helmholtz damper 100 replicate the same resonance frequency Fn as 150 Hz, then assuming:

Lv'=Lv (i.e. length of annular damper 100 resonator equals length of traditional damper's resonator)

Rv'=0.1 m (radius of resonator of damper 100, as shown in FIG. 3)

Drv (difference between radii of concentric volumes 10 and 20) can be calculated as:

$$\pi((Rv'+Drv/2)^2-(Rv'-Drv/2)^2)=\pi Rv^2$$

Hence, Drv=0.014 m

Also, if assuming damper 100 has 9 necks 30 instead of one as in traditional damper, then Rn' (radius of damper 100 neck 30) can be calculated as:

$$9*\pi*Rn'^2=\pi*Rn^2$$

Hence, Rn'=Rn/3=0.005 m (radius of neck 30)

This means that radius of outermost volume 10 is Rv'+Drv/2=0.107 m

In other words, in this annular design of damper 100 the differential distance between two volumes 10 and 20, i.e., Drv is 0.014 m is greater than radius of each neck 30 Rn'=0.005 m, such that it is sufficient to accommodate these necks within the annular volume 22.

Figure 4A:
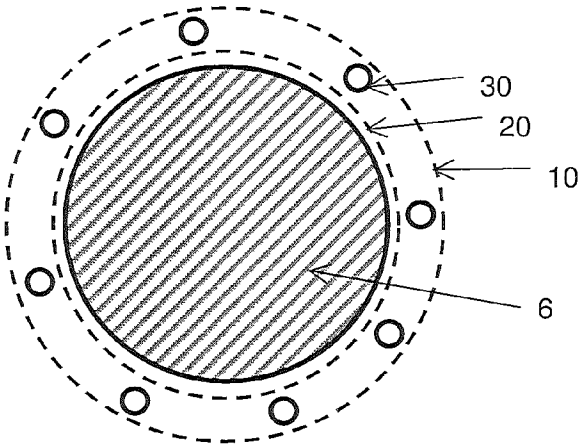
FIGS. 4A and 4B show a top view of the annular Helmholtz damper positioned around the burners in the burner front panel in accordance with an embodiment of the invention.
Figure 4B:
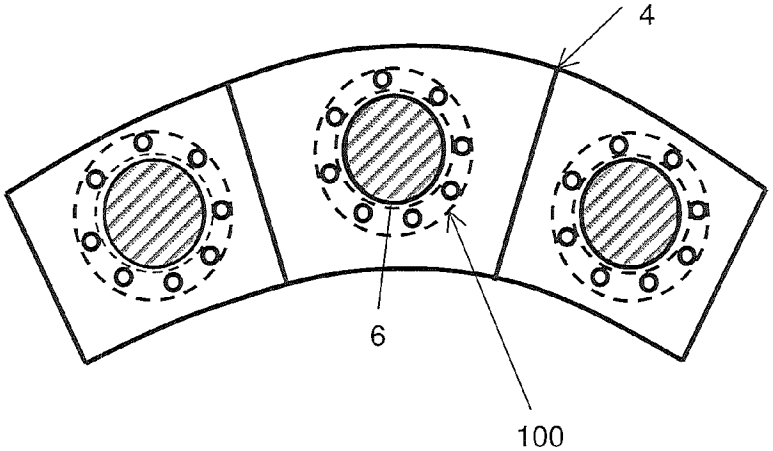

FIGS. 4A and 4B show a top view of the annular Helmholtz damper positioned around the burners 6 in the burner front panel 4 in accordance with an embodiment of the invention. In FIG. 4A, from top view the burner 6 cross-section is shown as circular and damper 100 has its two volumes 10 and 20 is being represented as two concentric circles around the burner 6 cross section. Also, cross-section of each neck 30 is represented by circles in annular volume 22.

Figure 2:
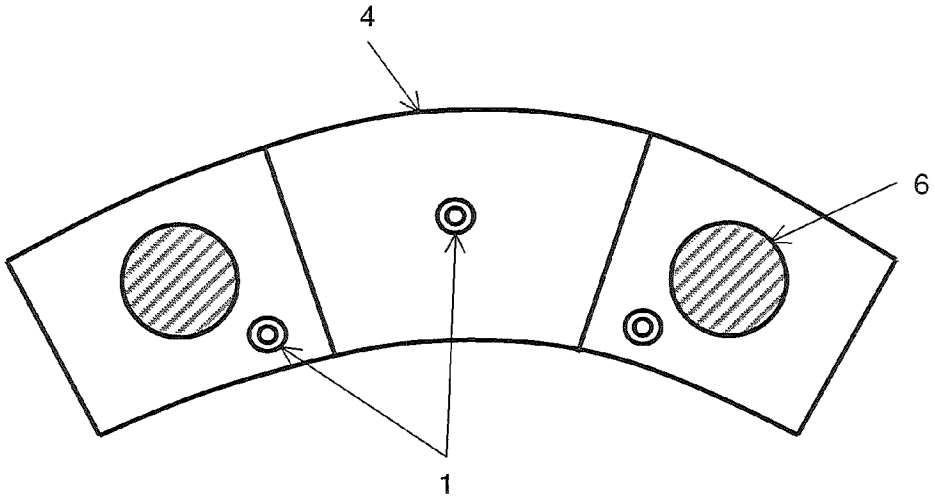
FIG. 2 shows top view of a burner front panel with traditional Helmholtz dampers according to the prior art.

Referring to FIG. 4B, in comparison to FIG. 2 (prior art), such an arrangement of damper 100 around burner 6, can be replicated for all burners in the front panel wall 4. Hence, damper 100 installation resolves the issue of space constraint around the burner front panel wall 4.

It will be apparent to a person skilled in the art that this design is only exemplary and the damper may be arranged in various other neck and volume combinations. The design of damper 100 could be easily extended to variable number of interconnected hollow shapes 10 and 20 and necks 30 to combustion chamber 5, depending on the number of dominant frequencies that need to be damped. In accordance with another embodiment of the invention, damper 100 may be used to damp only one dominant frequency that has maxima at the locations where the one or more necks 30 contact with combustion chamber 5. In accordance with various embodiments of the invention, the one or more contact points are located on a circumferential periphery of burner 6 that is connected to combustion chamber 5. Moreover, the contact points at which damper 100 may touch combustion chamber 5 may be distributed in three dimensions. It is only for the sake of simplified explanation that all embodiments have been shown in two dimensions however, this does not limit the scope of this invention.

Figure 5:
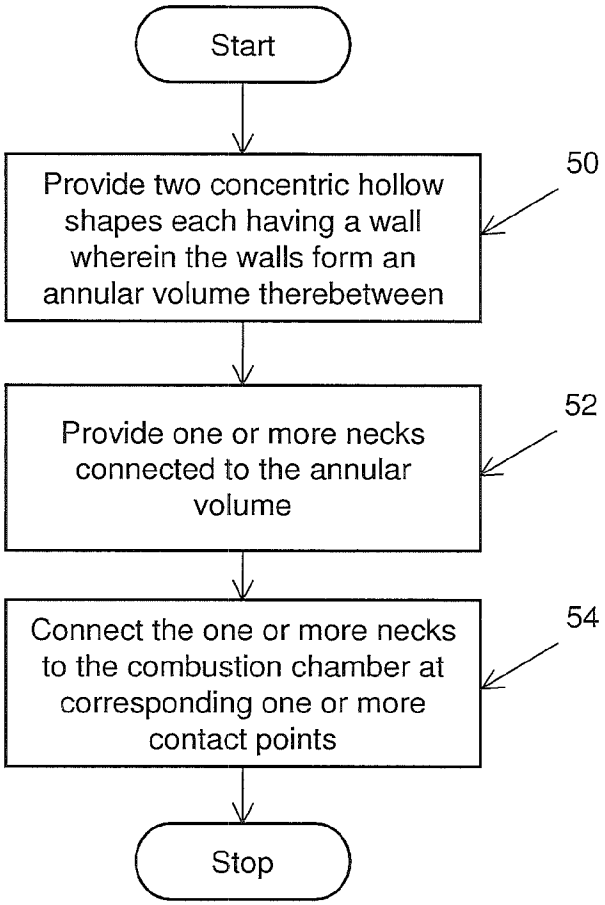
FIG. 5 is a flowchart of a method of designing an annular Helmholtz damper in accordance with an embodiment of the invention.

In accordance with an embodiment of the invention, FIG. 5 describes a flowchart of a method of designing damper 100 for combustion chamber 5. At first step 50, two concentric hollow shapes 10 and 20 are provided, each having a wall 11 and 12, wherein the walls 11 and 12 form an annular volume 22 therebetween. Thereafter, at second step 52, one or more necks 30 are provided that are connected to the annular volume 22. At final step 54, the one or more necks are connected to combustion chamber 5 at corresponding one or more contact points. In accordance with an embodiment of this invention, the one or more contact points are located around circumferential perimeter of burner 6. In this manner, damper 100 is located around burner 6 thus resolving the issue of space constraint around the burner front panel 4.

Figure 6A:
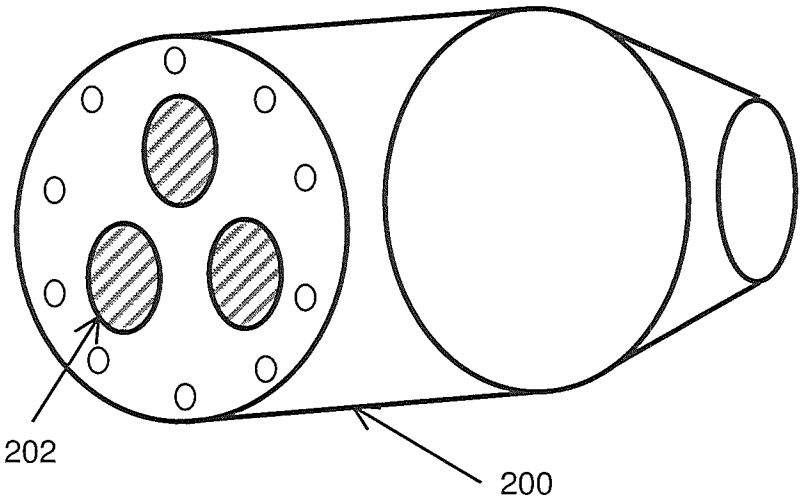
FIGS. 6A and 6B show side view and top view of annular Helmholtz damper positioned around the burners in a can-nular combustion chamber in accordance with an embodiment of the invention.
Figure 6B:
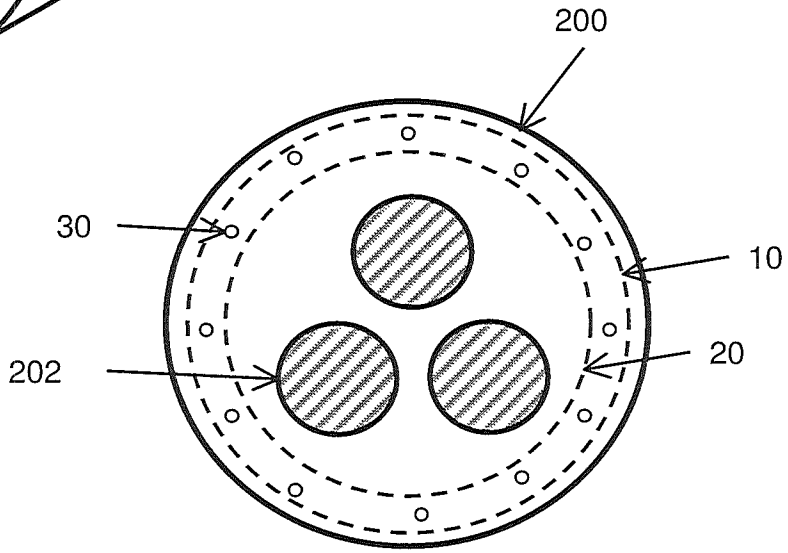

In accordance with another embodiment of the invention, FIGS. 6A and 6B show side view and top view of annular Helmholtz damper positioned around the burners in a cannular combustion chamber 200. Instead of a regular combustion chamber (i.e. combustion chamber 5), cannular combustion chamber 200 has multiple burners 202 per combustor chamber. In this embodiment, cannular combustion chamber 200 has three burner 202 per combustor. Such cannular combustion chamber 200 may also be applicable for installation of annular Helmholtz damper 100.

FIG. 6B shows the top view of cross section of cannular combustion chamber 200. Damper 100 having two hollow concentric volumes 10 and 20 is placed such that it surrounds all three burners 202 together. In effect, volumes 10 and 20 are concentric to the circumferential perimeter of cannular combustion chamber 200. Further, one or more necks 30 connect the damper 100 to cannular combustion chamber 200. By such an arrangement, damper 100 is able to provide requisite damping effect even in a cannular combustion chamber by serving multiple burners per damper.

In all embodiments described so far, damper 100 represents one annular volume 22 that is formed between two concentric hollow shapes 10 and 20. However, in accordance with various other embodiments of the invention, in order to modify/fine tune the damping characteristics and damping frequency of damper 100, it is possible (within the scope of the invention) to have multiple annular volumes arranged in series and/or parallel combination with respect to the necks 30, to achieve the desired results. In accordance with various forthcoming embodiments of the invention, various possibilities of arranging such interconnections between hollow shapes 10 and 20 and necks 30 are explained.

Figure 7:
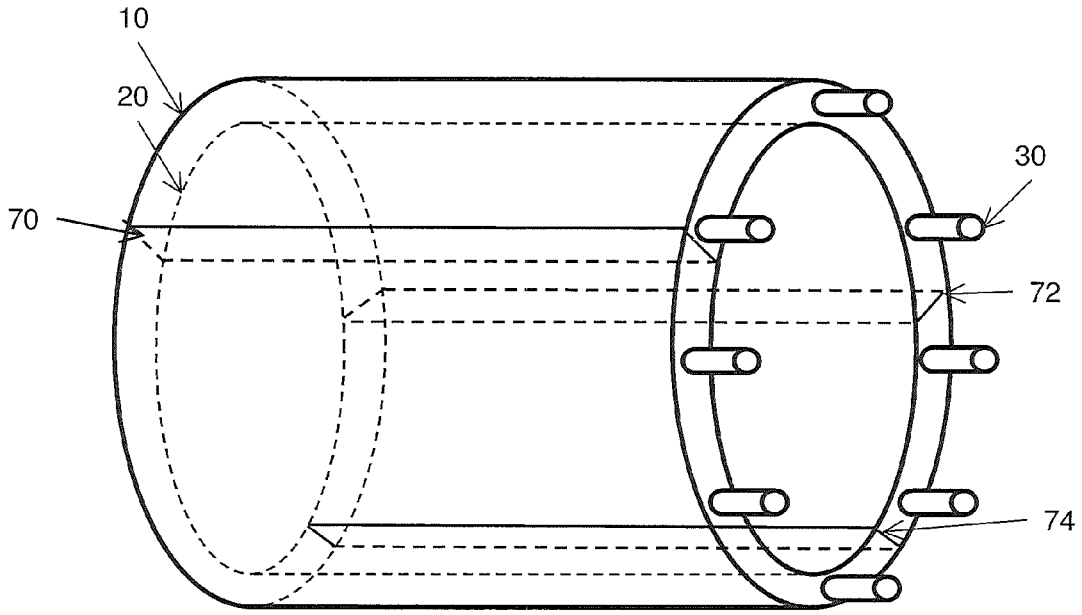
FIG. 7 shows an arrangement of the annular Helmholtz damper with multiple volumes in accordance with an embodiment of the invention.

FIG. 7 shows an arrangement of the annular Helmholtz damper with multiple volumes in accordance with an embodiment of the invention. The damper may have one or more plates that extend in longitudinal direction between the two concentric hollow shapes 10 and 20. In this embodiment, damper 100 has three plates 70, 72 and 74 that extend longitudinally (along the length) within the annular volume 22. Each plate defines a first annular volume at a first side of the plate, and a second annular volume at a second side of the plate. Thus, the annular volume 22 is divided into three annular volumes that are connected in parallel to each other. In accordance with various embodiments of the invention, these plates are moveable along the circumference of damper 100 to vary the three annular volumes. This provides more possibilities to fine tune damper 100 to one or more pulsation frequencies in combustion chamber 5.

Figure 8:
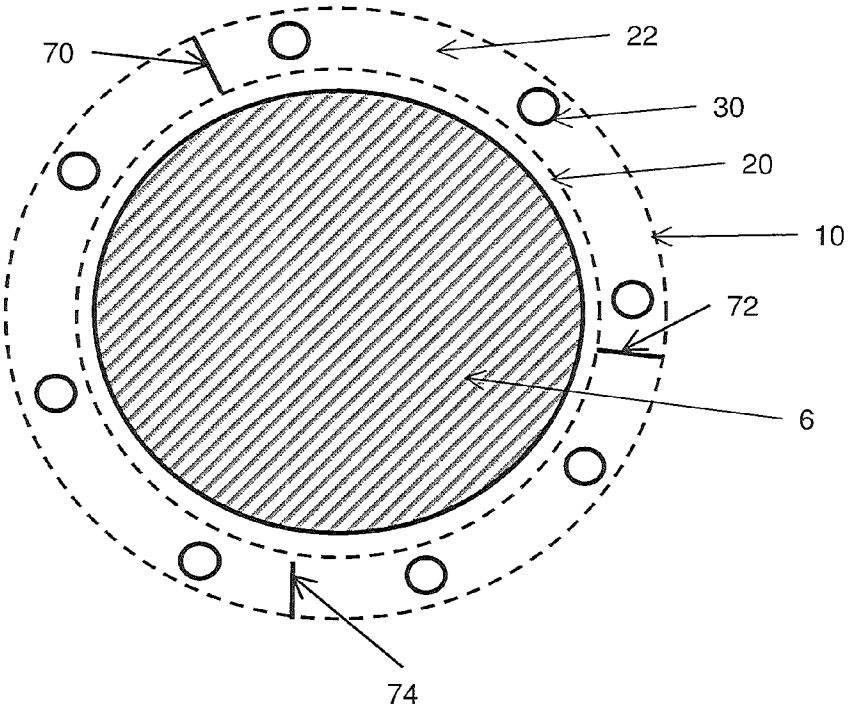
FIG. 8 shows a top view of the arrangement described in FIG. 7 in accordance with an embodiment of the invention.

FIG. 8 shows a top view of the arrangement described in FIG. 7 in accordance with an embodiment of the invention. Burner 6 cross section is shown in circular shape and damper 100 having annular volume 22 defined between two volumes 10 and 20 is represented as two concentric circles around the burner 6 cross section. The cross-section of each neck 30 is represented by circles in annular volume 22. Further, the plates 72, 74 and 76 create three volumes in parallel.

It will be apparent to a person skilled in the art that the division of annular volume 22 into three volumes using three plates is only exemplary and can be limited to multiple volumes depending on the tuning requirements of damper without limiting the scope of the invention. In various embodiments of the invention, the multiple volumes may be further fine tuned to effectively change the damping characteristics of damper 100.

Figure 9:
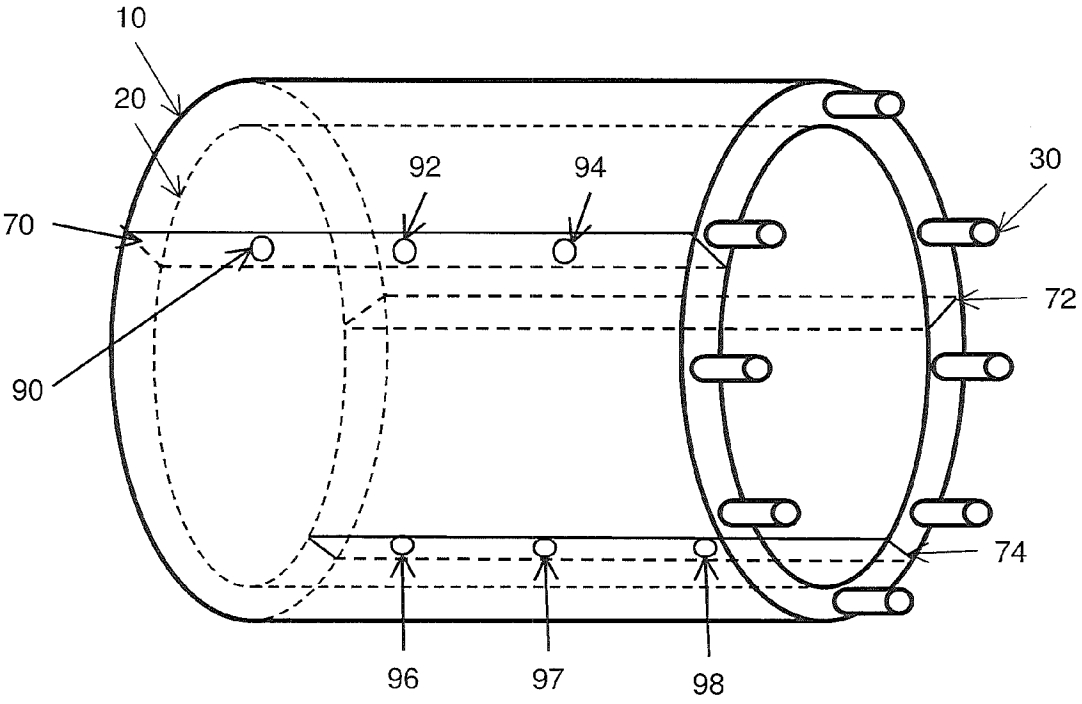
FIG. 9 shows an arrangement of the annular Helmholtz damper with multiple volumes that interconnected through various necks in accordance with an embodiment of the invention.

FIG. 9 shows an arrangement of the annular Helmholtz damper 100 with multiple volumes that interconnected through various necks 30 in accordance with an embodiment of the invention. Continuing from the exemplary damper 100 shown in FIG. 7, the damper 100 in FIG. 9 also has the plates 70, 72 and 74 that divide the annular volume 22 into three volumes. The plate 70 has three necks 90, 92 and 94 that interconnect a first volume and second volume on either side of plate 70. Similarly, plate 74 has three necks 96, 97 and 98 that interconnect a first volume and second volume on either side of plate 74. In one embodiment of the invention, the necks are hollow tubular cylinders that are positioned along the length of the plate and create an opening between the first volume and second volume on either side of the plate. Three necks with the plates 70 and 74 are only taken in this exemplary embodiment; however, different number of necks may be used in one or more plates depending on damping requirements.

It will be apparent to a person skilled in the art that resonance frequency of damper 100 can be varied by varying the geometry of necks and volumes that is achieved by changing the structure/cross-section of the volume and neck itself. Even though in all above-mentioned embodiments, cross-sectional shape of volumes and neck are shown as circular, the volumes and necks are not limited to just this shape. In accordance with various embodiments of the invention, volumes and necks may have a polygonal, cubical, cuboidal, spherical or any non-regular shape. Any of these shapes (not shown) could be used to define the damper arrangement 100 depending on the damping requirements of combustion chamber 5.

Figure 10:
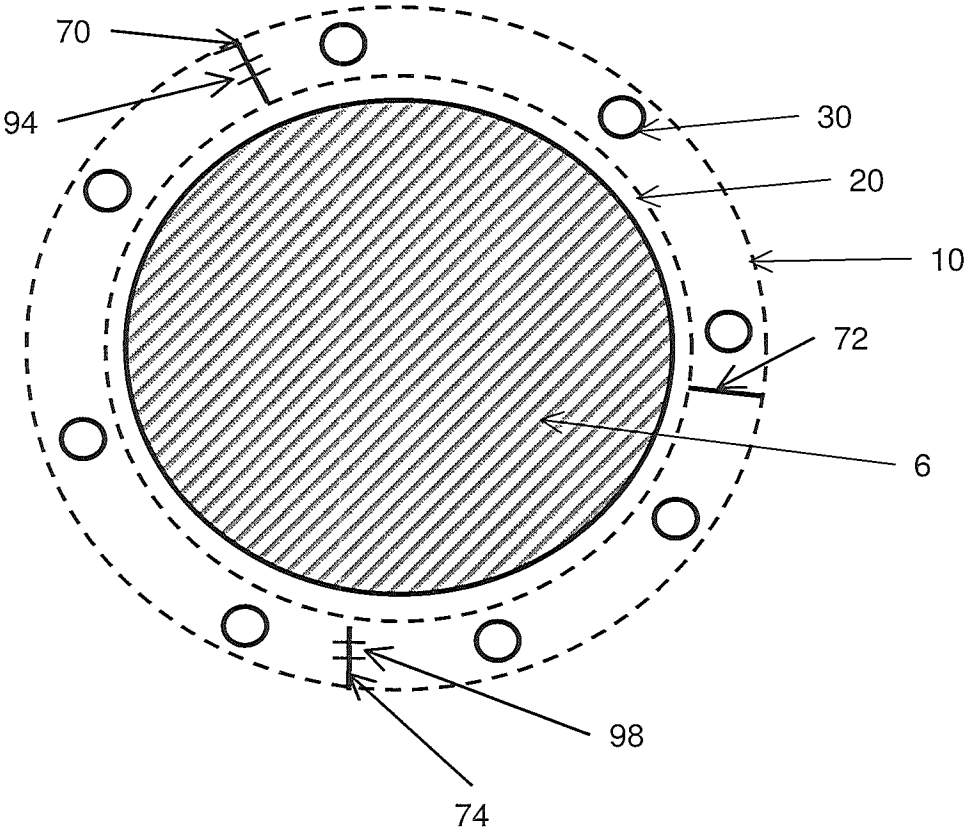
FIG. 10 shows a top view of the arrangement described in FIG. 9 in accordance with an embodiment of the invention.

FIG. 10 shows a top view of the damper 100 described in FIG. 9 in accordance with an embodiment of the invention. Burner 6 cross section is shown in circular shape and damper 100 having annular volume 22 defined between two volumes 10 and 20 is represented as two concentric circles around the burner 6 cross section. The cross-section of each neck 30 is represented by circles in annular volume 22. The plates 72, 74 and 76 divide the annular volume 22 into three volumes that are interconnected in parallel. Each of the plate 70 and 74 have three necks. Cross section of the lower most necks 94 and 98 (i.e., neck closest to necks 30) is shown for plates 70 and 74 respectively.

Figure 11:
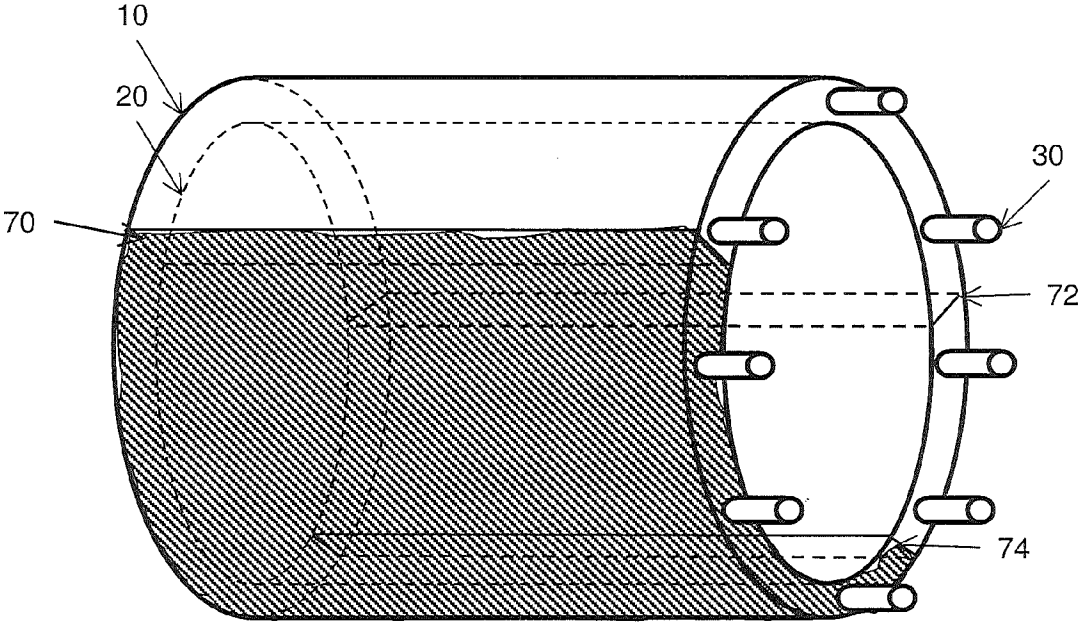
FIG. 11 shows an annular Helmholtz damper using filler materials to adjust acoustic coupling between the volumes, in accordance with an embodiment of the invention.

It will be apparent to a person skilled in the art that the divided annular volumes may also be filled with various filler materials to further fine tune the damping characteristics of damper 100. FIG. 11 shows the annular Helmholtz damper 100 using filler materials to adjust acoustic coupling between the volumes, in accordance with an embodiment of the invention. The annular volume 22 formed between plates 70 and 74 is filled with a filler material (represented by shaded pattern). The filler material such, but not limited to, a porous material, an absorptive material, an adsorptive material, a perforated screen and a metal foam, may be used. The inclusion of such filler material helps in modifying the damping characteristics of damper 100. In accordance with another embodiment of the invention, similar kind of filler material may also be used in one or more necks 30 to further fine tune the damper 100.

In various other embodiments of the invention, such filler material may even be used in necks that interconnect the volumes, i.e., necks 90 to 98 (refer FIG. 9). Within the scope of the invention, any combination of necks and volumes may have such filler material, to allow for fine tuning of damper 100.

It will be apparent to a person skilled in the art that all these variations of using filler material in either of volumes or necks is purely exemplary. Any of these volumes or necks may use such material to change the acoustic properties of the volumes and necks and thus adjust the damping characteristics of the overall damper arrangement 100.

Figure 12:
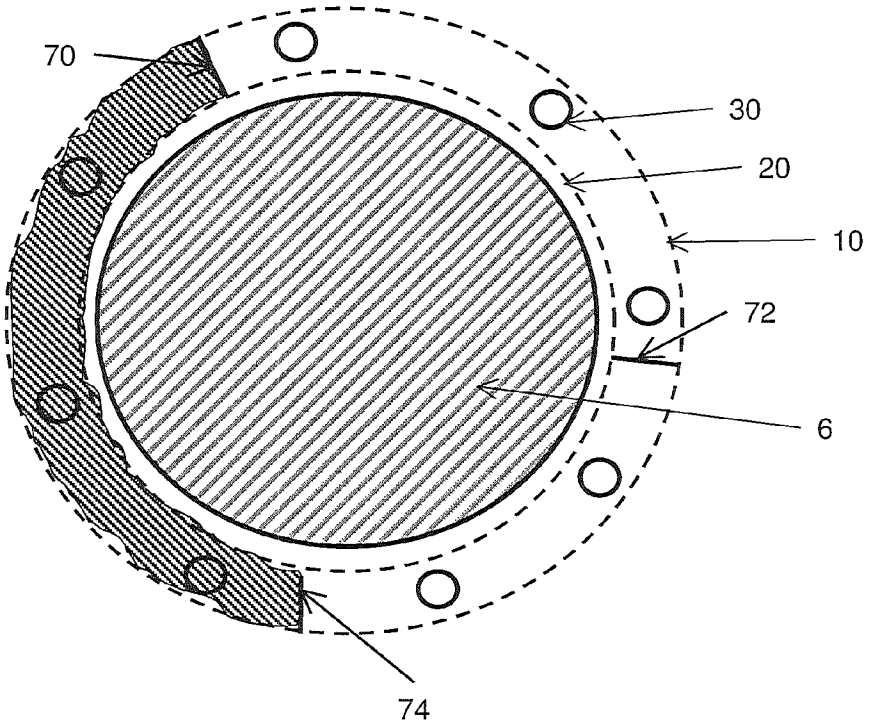
FIG. 12 shows a top view of the arrangement described in FIG. 11 in accordance with an embodiment of the invention.

FIG. 12 shows a top view of damper 100 arrangement as described in FIG. 11 in accordance with an embodiment of the invention. Burner 6 cross section is shown in circular shape and damper 100 having annular volume 22 defined between two volumes 10 and 20 is represented as two concentric circles around the burner 6 cross section. The cross-section of each neck 30 is represented by circles in annular volume 22. The plates 72, 74 and 76 dividing the annular volume 22 into three volumes that are interconnected in parallel, are shown by three lines. The filler material between plates 70 and 74 is shown by shaded pattern.

Figure 13:
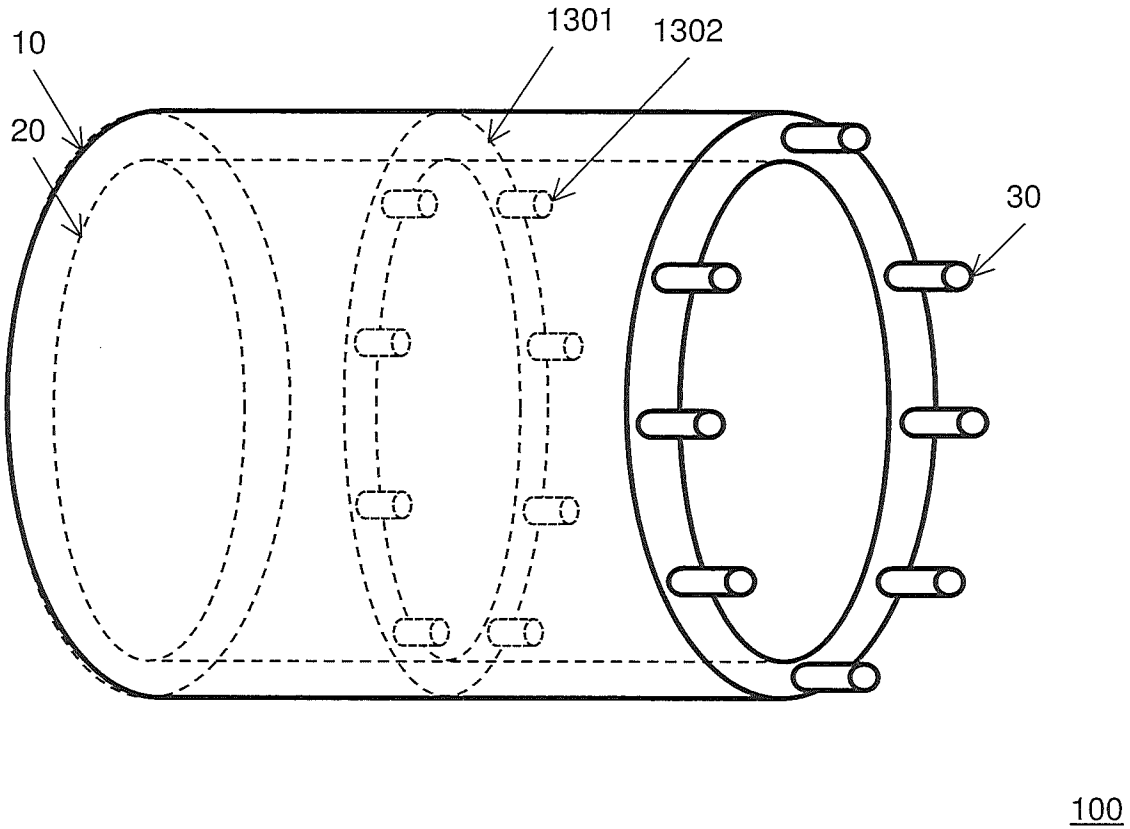
FIG. 13 shows an arrangement of the annular Helmholtz damper with multiple volumes interconnected in series, in accordance with various embodiments of the invention.

Extending the concept of interconnecting annular volumes in parallel, the annular volumes may also be connected in series, within the scope of the invention. FIG. 13 shows an arrangement of the annular Helmholtz damper 100 with multiple annular volumes interconnected in series, in accordance with various embodiments of the invention. In comparison to the embodiment described in FIG. 7, wherein plates are inserted in longitudinal direction to divide the annular volume 22 into multiple volumes; in FIG. 13, one or more plates are inserted circumferentially within annular volume 22, such that it divides the annular volume 22 into two or more annular volumes that are connected in series. As shown in FIG. 13, a plate 1301 is inserted circumferentially between volume 10 and volume 20. Further, plate 1301 has one or more necks 1302 that interconnect two volumes, a first volume and a second volume that are created on either side of plate 1301. Thus, the entire arrangement of damper 100 in this embodiment has two annular volumes interconnected in series.

It will be apparent to a person skilled in the art that in this arrangement, the position and size of necks 1302 may be varied, in addition to location of plate 1301 in order to vary the damping characteristics of damper 100. Moreover, more than one such plate 1301 may be added to create more than two annular volumes in series. Also, the combination of necks and volumes may have filler materials to further fine tune the damper characteristics.

Figure 14:
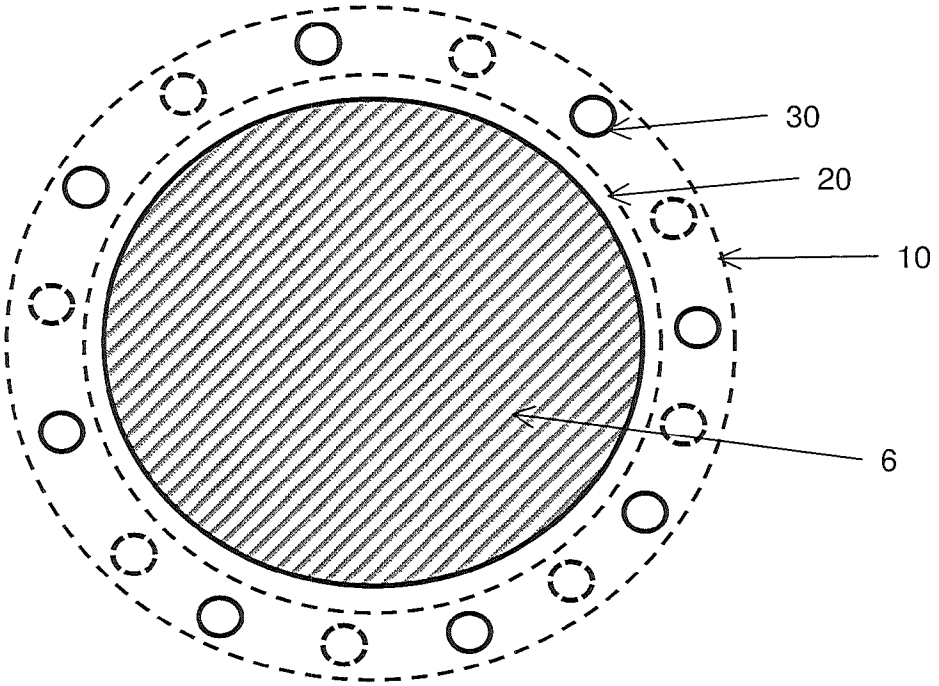
FIG. 14 shows a top view of the arrangement described in FIG. 13 in accordance with an embodiment of the invention.
Figure 15:
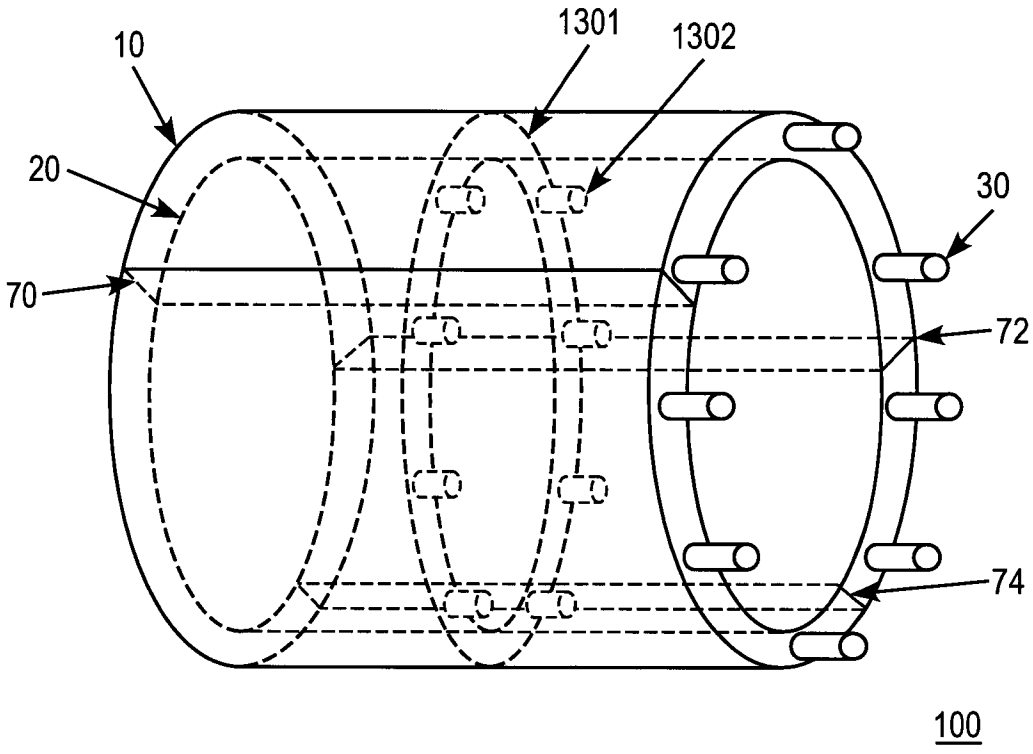
FIG. 15 shows an arrangement of the annular Helmholtz damper with multiple volumes interconnected in series and in parallel, in accordance with various embodiments of the invention.

FIG. 14 shows a top view of the arrangement described in FIG. 13 in accordance with an embodiment of the invention. Burner 6 cross section is represented in circular shape and damper 100 having annular volume 22 defined between two volumes 10 and 20 is represented as two concentric circles around the burner 6 cross section. The cross-section of plate 1301 is concentric to cross-section of hollow shapes 10 and 20. The cross-section of each neck 30 is represented by circles in annular volume 22. The cross-section of necks 1302 is represented by dotted circles in annular volume 22.

It will be appreciated by a person skilled in the art that the invention through its various embodiments only provides some exemplary design to illustrate the concept of interconnected volumes and necks. These embodiments do not in any sense intend to limit the scope of the invention to just these arrangements.

Naturally, all features described in mentioned text may be independently provided from one another. In practice, the materials used and the dimensions can be chosen at will according to requirements and to the state of the art.

While exemplary embodiments have been described with reference to gas turbines, embodiments of the invention can be used in other applications where there is potential requirement of damping pressure oscillations.

Further, although the disclosure has been herein shown and described in what is conceived to be the most practical exemplary embodiment, it will be recognized by those skilled in the art that departures can be made within the scope of the disclosure, which is not to be limited to details described herein but is to be accorded the full scope of the appended claims so as to embrace any and all equivalent devices and apparatus.

The invention claimed is:

1. A damper arrangement comprising:

two concentric hollow shapes, each having a wall, wherein the walls form an annular damper volume therebetween; and one or more necks for connecting the annular damper volume to a combustion chamber at corresponding one or more contact points, the one or more necks further being connected to the annular damper volume, wherein the annular damper volume comprises one or more first plates extending longitudinally between the walls of the two concentric hollow shapes.

2. The damper arrangement as claimed in claim 1, wherein the one or more contact points are located on a circumferential periphery of one or more burners connected to the combustion chamber.

3. The damper arrangement as claimed in claim 2, wherein the annular damper volume is concentric to a burner.

4. The damper arrangement as claimed in claim 1, wherein the combination of the annular damper volume and the one or more necks are tuned to damp one or more pulsation frequencies.

5. The damper arrangement as claimed in claim 1, wherein the annular damper volume comprises one or more second plates extending circumferentially, between the walls of the two concentric hollow shapes.

6. The damper arrangement as claimed in claim 1, wherein the one or more first plates defines a first damper volume at a first side of one plate of the one or more first plates and a second damper volume at a second side of the one plate of the one or more first plates.

7. The damper arrangement as claimed in claim 6, wherein the one or more first plates are movable, wherein the one or more first plates have one or more necks therethrough so as to interconnect the first and second damper volumes.

8. The damper arrangement as claimed in claim 7, wherein the first and second damper volumes have variable sizes and volumes.

9. The damper arrangement as claimed in claim 8, wherein the corresponding one or more necks for the respective first and second damper volumes have variable sizes and volumes.

10. The damper arrangement as claimed in claim 1, wherein at least one of the annular damper volume and one or more necks comprises one or more of a porous material, an absorptive material, an adsorptive material, a perforated screen and a metal foam therein.

11. A method for designing a damper arrangement, the method comprising:

providing two concentric hollow shapes each having a wall, wherein the walls form an annular damper volume therebetween;

providing one or more necks being connected to the annular damper volume;

connecting the one or more necks to a combustion chamber at corresponding one or more contact points; and inserting within the annular damper volume one or more first plates extending in a longitudinal direction between the walls of two concentric hollow shapes.

12. The method as claimed in claim 11 comprising:

locating one or more contact points on a circumferential periphery of one or more burners connected to the combustion chamber.

13. The method as claimed in claim 11 comprising:

tuning the combination of the annular damper volume and the one or more necks to damp one or more pulsation frequencies.

14. The method as claimed in claim 11 comprising:

varying the size and volume of the one or more necks and the annular damper volume.

15. The method as claimed in claim 11 comprising:

inserting within the annular damper volume one or more second plates extending in a circumferential direction between the walls of two concentric hollow shapes.

16. The method as claimed in claim 15, wherein the one or more second plates is movable and define a third damper volume at a first side of one plate of the one or more second plates and a fourth annular damper volume at a second side of the one plate of the one or more second plates.

17. The method as claimed in claim 11, wherein the one or more plates is movable and define a first annular volume at a first side of one plate of the one or more first plates and a second annular volume at a second side of the one plate of the one or more first plates.

* * * * *